US011440779B2

(12) United States Patent
Ringler et al.

(10) Patent No.: US 11,440,779 B2
(45) Date of Patent: Sep. 13, 2022

(54) DECOUPLEABLE LIFTING PLATFORM RECEPTACLE

(71) Applicant: Dr. Ing. h.c.F. Porsche Aktiengesellschaft, Stuttgart (DE)

(72) Inventors: Ralf Ringler, Sinzing (DE); Peter Horn, Enzweihingen (DE)

(73) Assignee: Porsche AG, Stuttgart (DE)

( * ) Notice: Subject to any disclaimer, the term of this patent is extended or adjusted under 35 U.S.C. 154(b) by 870 days.

(21) Appl. No.: 15/850,315

(22) Filed: Dec. 21, 2017

(65) Prior Publication Data

US 2018/0201490 A1 Jul. 19, 2018

(30) Foreign Application Priority Data

Jan. 17, 2017 (DE) ..... 10 2017 100 803.9

(51) Int. Cl.
*B66F 7/28* (2006.01)
*B66F 7/10* (2006.01)

(52) U.S. Cl.
CPC ..... *B66F 7/28* (2013.01); *B66F 7/10* (2013.01); *B66F 2700/123* (2013.01)

(58) Field of Classification Search
CPC ..... B66F 7/10; B66F 7/24; B66F 7/26; B66F 7/28; B66F 13/00; B66F 2700/123
See application file for complete search history.

(56) References Cited

U.S. PATENT DOCUMENTS

2010/0263942 A1* 10/2010 Hornstein ..... B66F 7/28 177/208
2015/0298901 A1 10/2015 Fjetland
2016/0368446 A1 12/2016 Schmitt
2017/0158476 A1 6/2017 Brunckhorst et al.
2017/0297472 A1* 10/2017 Thomas ..... B66F 7/00

FOREIGN PATENT DOCUMENTS

| | | |
|---|---|---|
| CN | 2756612 | 2/2006 |
| CN | 104837746 | 8/2015 |
| CN | 205573908 | 9/2016 |
| CN | 106256614 | 12/2016 |
| CN | 106829807 | 6/2017 |
| DE | 1727475 U | 8/1956 |
| DE | 19512063 A1 | 10/1996 |

OTHER PUBLICATIONS

Chinese Office Action dated Mar. 15, 2019.

* cited by examiner

*Primary Examiner* — Lee D Wilson
*Assistant Examiner* — Aaron R McConnell
(74) *Attorney, Agent, or Firm* — Gerald E. Hespos; Michael J. Porco

(57) ABSTRACT

The lifting platform (10) has at least two lateral pillars (12, 14, 33). Each pillar has height-changeable, pivotable arms (13, 34, 44) that are displaceable telescopically in length. An end of each arm has a decoupling device with a receptacle (31, 41) for supporting an object. A carrying device (11, 50) has receiving points corresponding to the number of the receptacles (31, 41). The lifting platform and the carrying device are positioned with respect to each other without impairing an object resting on the at least one receptacle. The at least one receptacle (31, 41) is placed onto the at least one receiving point, and the carrying device (11, 50) together with the transferred at least one receptacle (31, 41) and an object thereon is removed from a region of the lifting platform (10).

4 Claims, 6 Drawing Sheets

DECOUPLEABLE LIFTING PLATFORM RECEPTACLE

CROSS REFERENCE TO RELATED APPLICATION

This application claims priority under 35 USC 119 to German Patent Appl. No. 10 2017 100 803.9 filed on Jan. 17, 2017, the entire disclosure of which is incorporated herein by reference.

BACKGROUND

1. Field of the Invention

The invention relates to a method and a system for decoupling a receptacle of a lifting platform and for transferring the receptacle to a carrying device.

2. Description of the Related Art

A lifting platform is used to raise a motor vehicle in order to gain access to the underbody of the motor vehicle. The lifting platform generally comprises two lateral pillars. Pivotable and telescopic arms are located on the pillars and can be adjusted jointly in height. The arms can be pivoted under a motor vehicle located between the two pillars of the lifting platform and can be adjusted in length so that receptacles at free ends of the arms lie under receiving points of the motor vehicle. The receiving points are points provided by the manufacturer of the motor vehicle and define suitable points on the underbody at which the motor vehicle can be raised. Each receptacle generally is a flat supporting plate that sits on a threaded bolt. Thus, the receptacle can be height-adjusted by screwing the bolt into or out from the respective arm of the lifting platform. The lifting platform therefore can be adapted to conditions on the underbody of the motor vehicle.

DE 195 12 063 A1 describes a locking device for inserting a receptacle into a U-shaped end of a telescopic arm of the lifting platform. The receptacle can be introduced into an end of an arm even if the respective arm already has pivoted under the motor vehicle. This procedure is required when the guiding of the arms together with the receptacle under the vehicle is not possible because of a design of a motor vehicle and a resulting ground clearance of an edge of the motor vehicle.

A lifting platform that is used in the repair of a first motor vehicle generally is unavailable for a second motor vehicle until the repair of the first motor vehicle is completed. Delays may occur during a repair, for example, because a vehicle replacement part is not immediately available. The lifting platform then may be blocked for a relatively long time. The number of available lifting platforms in a garage is limited, and a backlog of repairs of further motor vehicles can arise. Certain types of repairs enable the motor vehicle to be lowered again and driven or rolled from the lifting platform. However, some repairs, such as those that concern an engine or a transmission, require sufficient disassembly to prevent the motor vehicle from being moved before the end of the repair.

SUMMARY

The invention relates to a method that includes decoupling receptacles from a lifting platform and transferring the receptacles to a carrying device. The lifting platform may have at least two lateral pillars, and each pillar has at least one height-changeable arm. Each arm is pivotal and also is telescopic so that the length of each arm is adjustable. A coupling and decoupling device is arranged on each arm and a receptacle is coupled temporarily on each arm for supporting an object. The carrying device has at least one receiving point for coupling a receptacle. The number of the receiving points corresponds to the number of the receptacles temporarily arranged on the lifting platform. The lifting platform and the carrying device are positioned with respect to each other so that the receptacles can be transferred from the lifting platform to the carrying device without adversely affecting an object resting on the receptacles. The receptacles then are placed onto the receiving points of the carrying device, and the carrying device subsequently is removed from a region of the lifting platform together with the transferred receptacles and an object located thereon.

"Height-changeable" within the context of this disclosure means the possibility of changing the height at which the respective arm is arranged on the pillar.

The terminology "the at least one receptacle is initially coupled to correspondingly at least one of the coupling and decoupling devices" means that, in the case of plural receptacles (which is generally the case), the receptacles initially are coupled to a corresponding plurality of coupling and decoupling devices. Thus, each receptacle is assigned a coupling and decoupling device, and vice versa.

The lifting platform can be used for raising any object with a bottom that must be accessed. For example, the object may be a boat or a large engine block. However, the following description will describe the method of the invention with a motor vehicle as the object. Known lifting platforms generally are used in a motor vehicle garage and have two pillars, and each pillar has two arms. Thus, there generally are four receptacles on which an underbody of the respective motor vehicle rests.

A lifting platform that is used over the course of a repair or for performing general work on a motor vehicle may have two pillars, and two arms may be arranged on each pillar. A coupling and decoupling device with a receptacle arranged temporarily thereon is at an end of each arm. Accordingly, the lifting platform has four arms and four coupling and decoupling devices. As a result, the lifting platform can be provided, at least temporarily, with four receptacles and can be used for carrying or raising a motor vehicle.

A motor vehicle resting on the above-described lifting platform can be transferred to a carrying device that has a total of four supporting points for the four receptacles that initially are arranged on the lifting platform and on which the motor vehicle rests. The transfer of the motor vehicle from the lifting platform to the carrying device may involve initially positioning the lifting platform and the carrying device with respect to each other so that the respective supporting points of the carrying device come into a transfer position beneath the respective receptacles that still are coupled in or to the respective coupling and decoupling devices, and the receptacles can each be placed onto a corresponding receiving point. The receptacles are released from the respective coupling and decoupling devices of the lifting platform receptacles after the receiving points have been brought relative to each other into the transfer position so that there is no longer any connection between lifting platform and receptacles. At the same time or offset in time just a little, the receptacles are coupled captively to the respective receiving points as they are placed onto the receiving points or after being placed thereon. Therefore, an inadvertent detachment of the receptacles from the receiving points and therefore from the carrying device is avoided. The carrying device with the motor vehicle resting on the receptacles then can be removed from the lifting platform.

The at least one receptacle may comprise a supporting plate that sits on a threaded bolt, and the threaded bolt may be accommodated by a threaded sleeve. A bore may extend up into the bottom of the threaded bolt, and a stud on the carrying device may be introduced into the bore for transferring the at least one receptacle.

Alternatively, an adapter may sit on a threaded bolt, and the threaded bolt may be accommodated by a threaded sleeve. The bottom end of the threaded bolt may have a bore, and a stud on the carrying device may be introduced into the bore for transferring the at least one receptacle. The adapter may be introduced upward into at least one receiving point provided by the manufacturer of the motor vehicle.

The motor vehicle can be deposited directly onto the carrying device, i.e. without decoupling the at least one receptacle located on the lifting platform if the at least one supporting plate is located on the underbody of the motor vehicle at a position in which it does not overlap further receiving points provided by the manufacturer of the motor vehicle. At least one skid sleeve may be tailored to the at least one receiving point provided by the manufacturer of the motor vehicle. The skid sleeve may have a bolt and a bore may extend up into the bottom end of the bolt. At least one stud of the carrying device can be introduced into the bore for transferring the motor vehicle.

The carrying device may have at least one displaceable crossbar in the upper region. Each end of the crossbar may have an arm that is pivotable and that also is changeable telescopically in length. The receiving point of the carrying device is located on the arm and may comprise a bolt onto which a threaded sleeve of the receptacle is plugged. If a motor vehicle is picked up by the above-described lifting platform having four receptacles, the corresponding carrying device may be a vehicle skid with two displaceable crossbars. A pivotable arm may be on each end of each crossbar and may be changeable telescopically in length. In this case, there are four pivotable arms and each arm has a receiving point designed as a stud. Each stud is configured to be introduced into the bore of the at least one receptacle.

Rollers can be fastened to the bottom of the carrying device and permit the carrying device to slide out of the region of the lifting platform. Diverse traction apparatuses known from the prior art (for example Ameise, Car Stringo, etc.) that enable the carrying device to be jacked up and are themselves provided with rollers are also conceivable here.

The method may be carried out so that the receptacle is detached from the corresponding receiving point of the carrying device and is coupled to a coupling and decoupling device at the end of an arms and that currently does not contain a receptacle.

The system of the invention is for decoupling at least one receptacle from a lifting platform and for transferring the at least one receptacle to a carrying device. The system includes a lifting platform with at least two lateral pillars. Each pillar has at least one pivotable arm that is displaceable telescopically in length. A coupling and decoupling device is at the end of each arm for coupling and/or decoupling a receptacle. The system further has a carrying device with at least one receiving point onto which at least one receptacle can be placed. The number of the receiving points corresponds to the number of the coupling and decoupling devices to which a receptacle can be coupled. The lifting platform and the carrying device are configured, for the transfer of the at least one receptacle initially arranged on the lifting platform from the lifting platform to the carrying device, to be positioned with respect to each other without adversely affecting an object resting on the at least one receptacle. The at least one receptacle is placed onto the at least one receiving point and is coupled to the carrying device and is detached or released from the corresponding coupling and decoupling device of the lifting platform. The carrying device together with the transferred at least one receptacle and an object located thereon is subsequently removable from a region of the lifting platform.

The decoupling device may be configured to function as a coupling and as a decoupling device. Therefore, a receptacle initially arranged on a receiving point of the carrying device can be transferred onto the lifting platform given suitable positioning of lifting platform and carrying device with respect to each other.

The at least one receptacle can therefore be arranged temporarily, depending on requirements, either on the lifting platform or on the carrying device. As a result, the lifting platform can be used more rapidly again and is not blocked by a possibly lengthy waiting process.

Further advantages and refinements of the invention emerge from the description and the attached drawings.

It goes without saying that the features mentioned above and those which have yet to be explained below can be used not only in the respectively stated combination, but also in other combinations or on their own without departing from the scope of the present invention.

DETAILED DESCRIPTION

Figure 1:
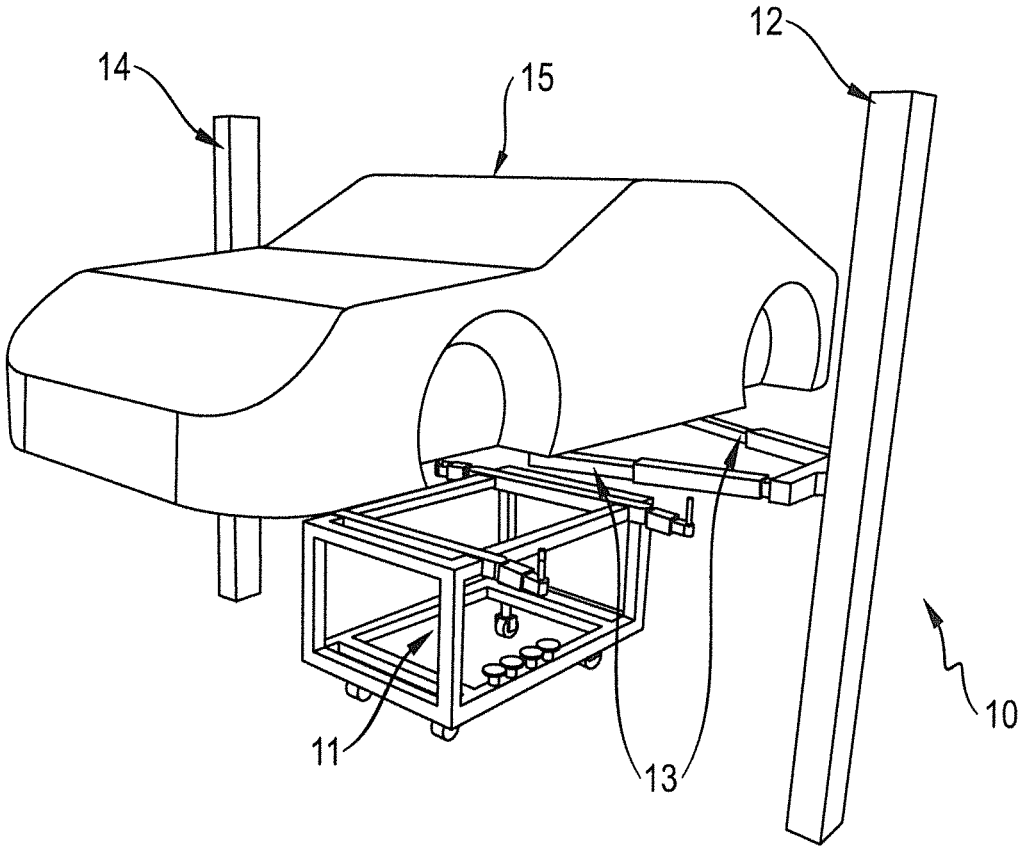
FIG. 1 is a perspective view showing a motor vehicle on a lifting platform in a garage and a carrying device to which the vehicle can be transferred.

FIG. 1 shows a lifting platform 10 with two lateral pillars 12 and 14. Two pivotable arms 13 are supported on each lateral pillar 12, 14, and each pivotable arm 13 is displaceable telescopically in length. A motor vehicle 15 is supported on receptacles of each arm 13 for repair at a position above the garage floor and is in a state of repair where the motor vehicle 15 cannot be rolled on its wheels. However, scheduling of parts or the like require the motor vehicle 15 to be moved from the lifting platform 10. Accordingly, a skid 11 is used to transfer the partly disassembled motor vehicle 15 from the lifting platform 10. The skid 11 is a carrying device that is moved to position below the motor vehicle 15.

Figure 2:
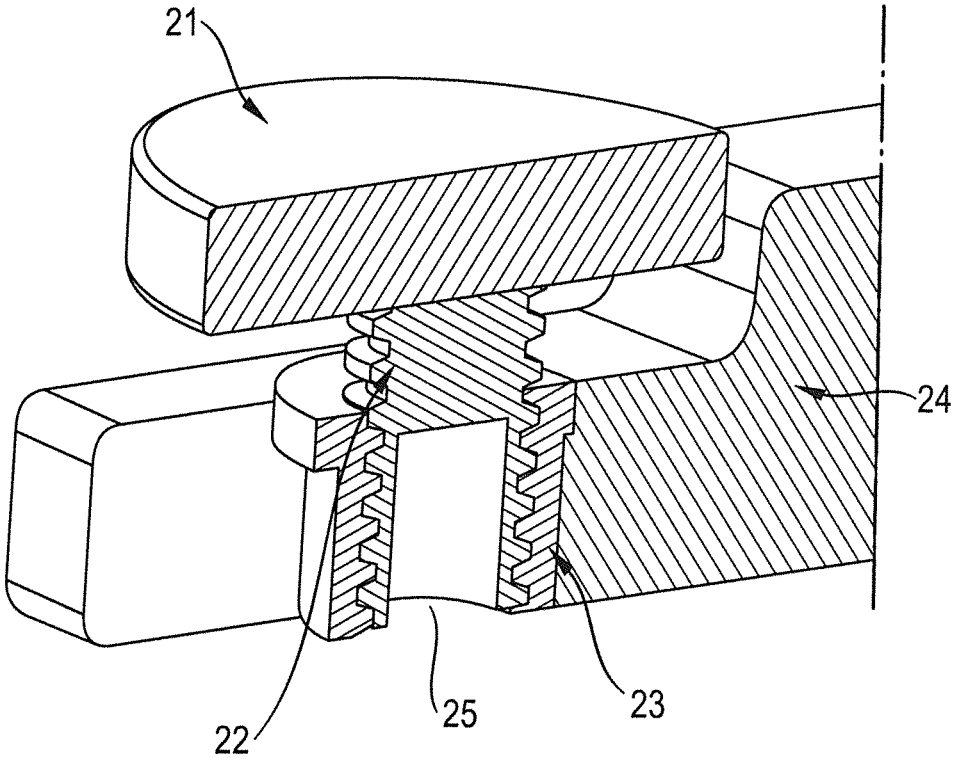
FIG. 2 is a cross-sectional view of a receptacle at the end of an arm of the lifting platform.

FIG. 2 is a sectional image of a receptacle that is plugged into an end 24 of an arm 13 of the lifting platform 10 and can be removed from the arm 13 (FIG. 1). The receptacle has a flat supporting plate 21 fixed to a top end of a threaded bolt 22 that is accommodated in a threaded sleeve 23. The supporting plate 21 and the threaded bolt 22 fixed thereto can be rotated to adjust height of the receptacle to adapt to conditions on an underbody of the motor vehicle 15. A bore 25 extends up into the lower end of the threaded bolt 22.

Figure 3:
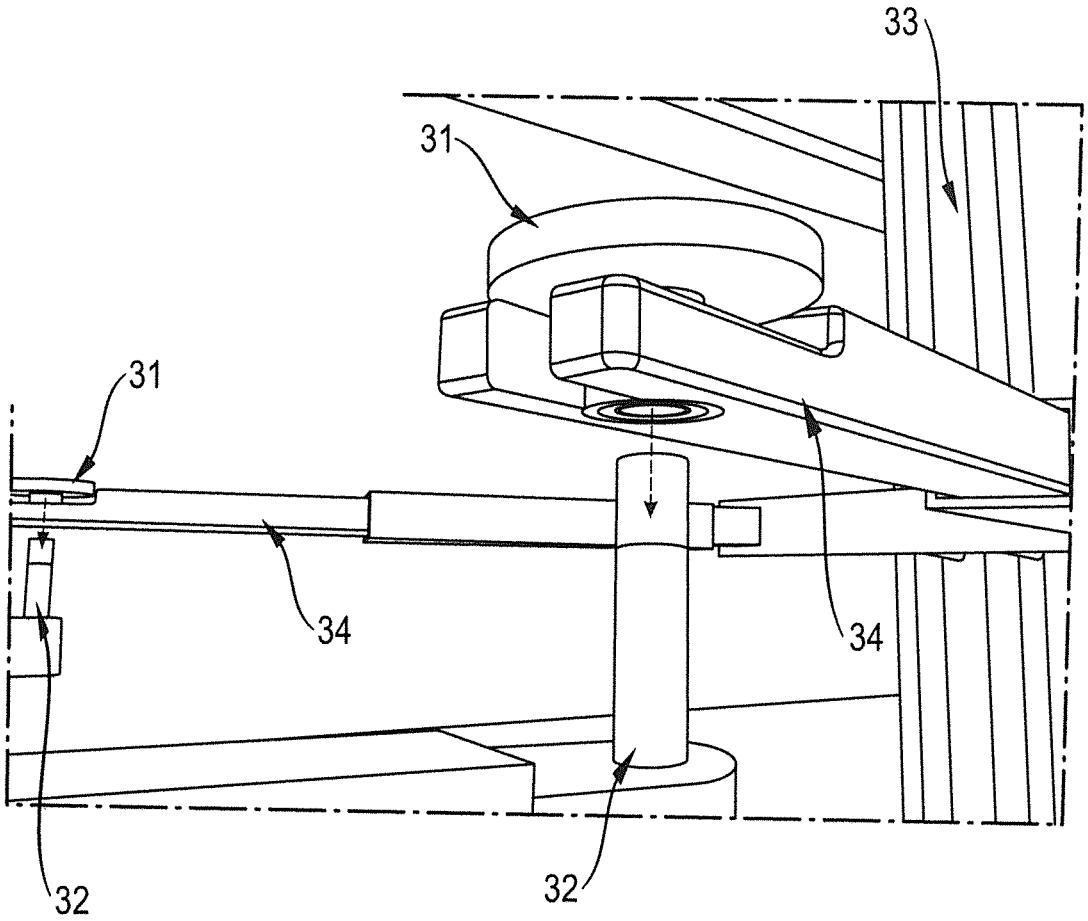
FIG. 3 is an exploded perspective view showing a receptacle that is about to be transferred from the lifting platform onto the carrying device.

FIG. 3 shows the two receptacles 31 associated with one lateral pillar 33 of the lifting platform 10 of FIG. 1. The motor vehicle located on the receptacles 31 has been omitted for better visibility of the operation. The vehicle skid 11 has pivotable arms that are changeable telescopically in length. Bolts 32 are provided on the pivotable arms 13 of the vehicle skid 11 and are positioned below the receptacles 31 that still are located in the arms 34 of the lifting platform 10 (note alignment lines formed by dashed arrows). The lifting platform is lowered slowly so that the bolts 32 enter centrally into the respective bores of the receptacles 31. The lifting platform 10 then is lowered until the bolts 32 of the carrying device or skid 11 completely fill the respective bores on the lower side of the receptacles 31. The receptacles 32 lift out of the holders at the end of the arms 13 of the lifting platform 10 and are no longer in contact with the ends of the arms 10 of the lifting platform 10. For this purpose, the bolts 32 of the carrying device or skid 11 have to have a suitable length.

Figure 4:
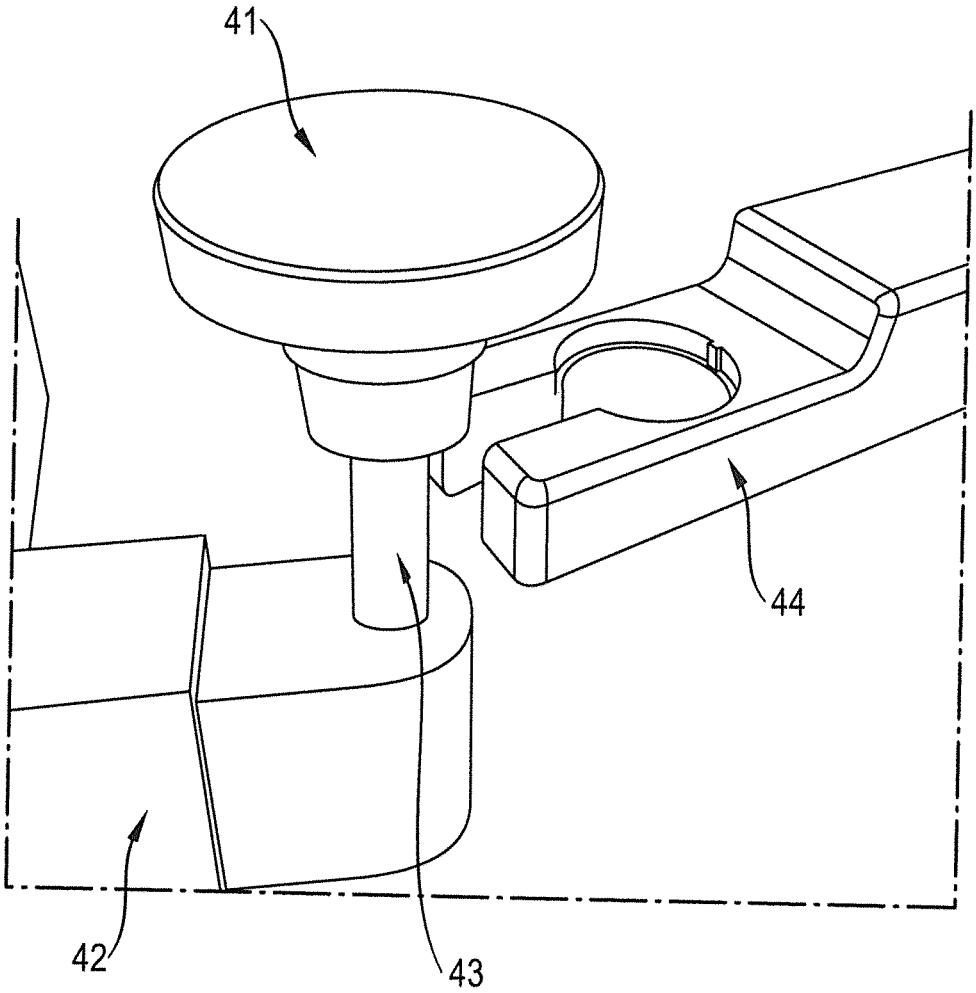
FIG. 4 is an exploded perspective view showing a receptacle that has been transferred from the lifting platform onto the carrying device.

FIG. 4 shows a receptacle 41 that has remained on a bolt 43 at an end of an arm 42 of the carrying device or skid 11. The arm 44 of the lifting platform 10 that previously contained the receptacle 41 has been shortened in length telescopically and thereby releases the bolt of the carrying device 11. The opening at the end of the arm 44 has a width so that the bolt 43 located on the carrying device can be guided out of the opening, but not the threaded sleeve of the receptacle 41. The threaded sleeve 23 was released only by lowering the lifting platform 10. The vehicle 11 has to be secured to the carrying device with a corresponding securing means (lashing straps, cable winch, chain hoist, etc.) before the lifting platform arms 13 are pulled back so that slipping of the load is avoided when the loaded carrying device or skid 11 is moved. The arms 13 of the lifting platform 10 then are pivoted to the side and the vehicle skid 11 can be removed together with the picked up motor vehicle 15 from the lifting platform region.

Figure 5:
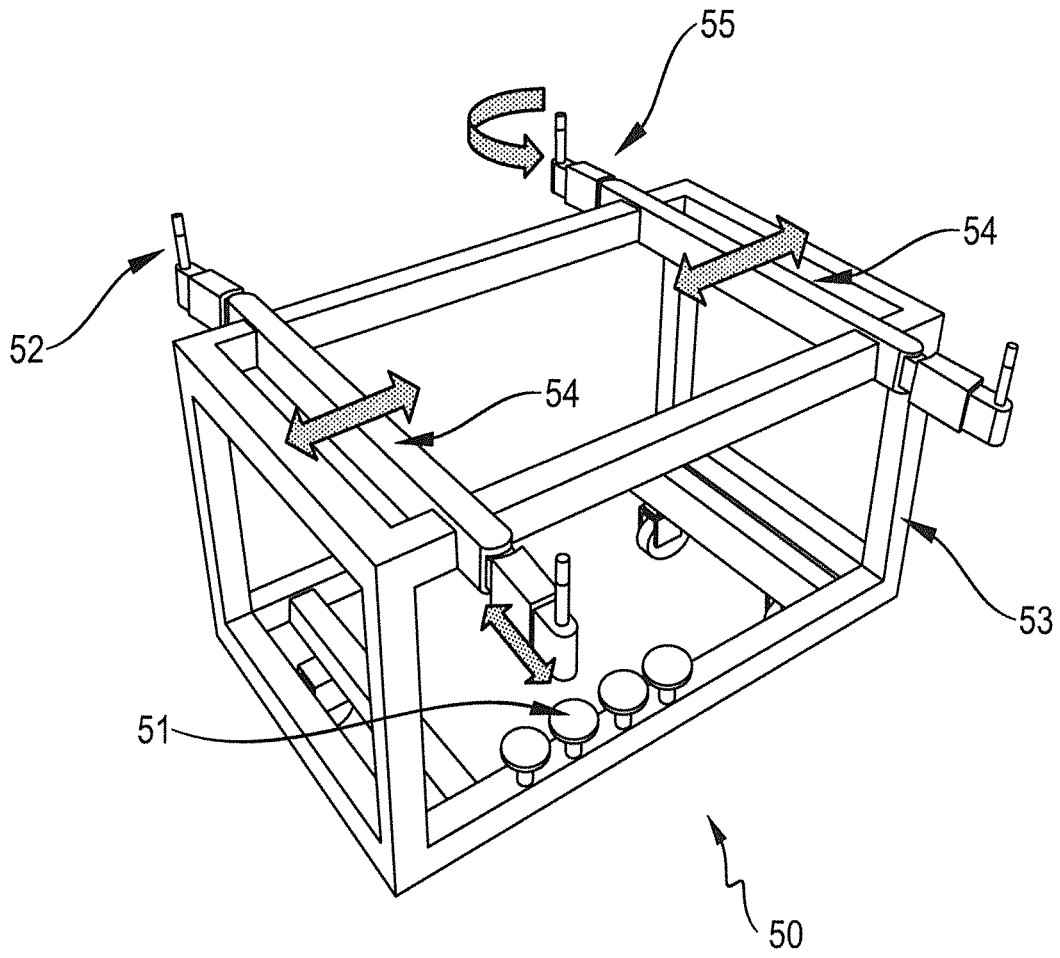
FIG. 5 is a perspective view of a carrying device designed as a vehicle skid.

FIG. 5 shows a carrying device 50 designed as a vehicle skid with a rectangular frame 53. Two displaceable crossbars 54 are located in the upper region of the frame 53, and pivotable arms 55 are located at both ends of each of the crossbars 54. Each pivotable arm 55 can be changed in length telescopically and an end of each arm 55 has a receiving point with a bolt 52 of suitable length and thickness for introducing into a correspondingly designed bore of a respective receptacle. Four further receptacles 51 are kept at a lower region of the frame 53. After transfer of the first four receptacles out of the arms 13 of the lifting platform 10 on which the motor vehicle is located. The four further receptacles can be introduced again into the now empty openings at the end of the arms of the lifting platform. The lifting platform is therefore provided for reuse.

Figure 6:
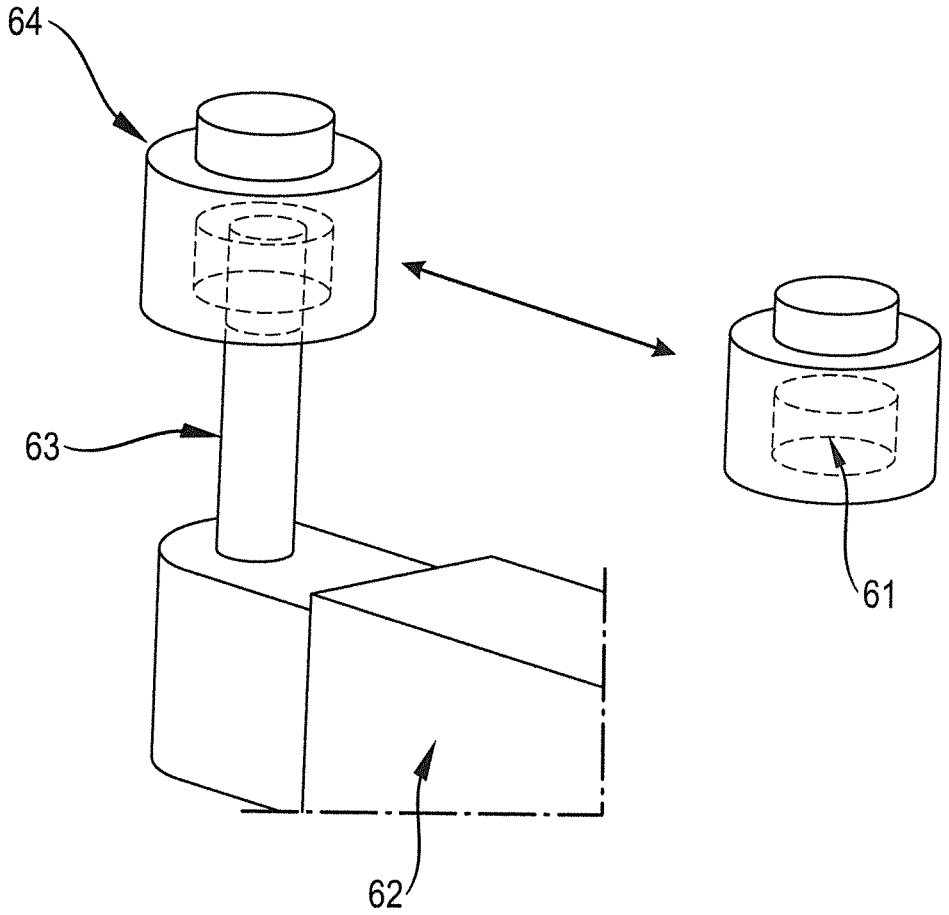
FIG. 6 is a perspective view of a skid sleeve and the seat thereof on a bolt of an embodiment of a carrying device according to the invention.

FIG. 6 shows a skid sleeve 64 that has been designed according to manufacturer specifications for a receiving point on the underbody of the motor vehicle. The receiving point has a bore 61 that can receive a bolt 63 at the end of a telescoping and pivotable arm 62 of the carrying device. The skid sleeve 64 is used whenever the four supporting plates are located at positions on the underbody of the motor vehicle in which further receiving points provided by the manufacturer of the motor vehicle are not overlapped, and therefore the motor vehicle can be deposited onto the carrying device directly, i.e. without decoupling the four receptacles located in the arms on the lifting platform.

What is claimed is:

1. A method for increasing utilization of a vehicle lifting platform by transferring a lifted vehicle from the lifting platform to a carrying device, the lifting platform having at least two laterally spaced apart pillars each of which has at least one height-changeable pivotable arm, each of the arms being telescopically displaceable in length and an end of each of the arms remote from the respective pillar having an opening, coupling and decoupling devices that include internally threaded sleeves temporarily arranged in the openings of the respective arms, externally threaded bolts threadedly engaged respectively with the internally threaded sleeves, bores extending into bottom ends of the bolts and supporting plates fixed to top ends of the bolts for supporting the vehicle, the method comprising:

displacing the arms so that the supporting plates align respectively with receiving points on an underbody of the vehicle;

raising the arms relative to the pillars so that the supporting plates approach the receiving points on the underbody of the vehicle;

rotating the bolts relative to the sleeves so that all of the supporting plates engage the receiving points on the underbody of the vehicle;

raising the arms farther along the pillars to lift the vehicle sufficiently to work on the underbody;

transferring the vehicle to the carrying device during a work interruption by:

positioning the carrying device under the vehicle;

individually adjusting receiving points of the carrying device to align with the bores in the bolts;

lowering the arms along the pillars so that the receiving points engage in the bores;

continuing lowering the arms so that the sleeves, the bolts and the supporting plates separate from the arms and remain on the receiving points;

moving the carrying device away from the lifting platform; and positioning new coupling and decoupling devices on the arms so that a further vehicle can be worked on during the work interruption.

2. The method of claim 1, in which the carrying device has first and second crossbars, at least the first crossbars being displaceable relative to the second crossbar, left and right arms mounted at opposite ends of each of the crossbars, each of the arms being pivotable and movable telescopically relative to the respective crossbar, and the receiving point located on said arm comprises a stud onto which the threaded sleeve of the receptacle is plugged, and the step of individually adjusting the receiving points of the carrying device to align with the bores in the bolts comprises individually pivoting the arms relative to the respective crossbar and individually telescopically moving the arms relative to the respective crossbar so that the receiving points of the carrying device align respectively with the bores in the bolts.

3. The method of claim 1, wherein the carrying device is a vehicle skid.

4. The method of claim 1, wherein the step of moving the carrying device away from the lifting platform region is carried out by operating a traction apparatus.

* * * * *